US007357274B2

(12) United States Patent
Hewett

(10) Patent No.: US 7,357,274 B2
(45) Date of Patent: Apr. 15, 2008

(54) TISSUE DISPENSER

(76) Inventor: Christopher B. Hewett, 605 W. Main St., Suite #004, Aspen, CO (US) 81611

( * ) Notice: Subject to any disclaimer, the term of this patent is extended or adjusted under 35 U.S.C. 154(b) by 1254 days.

(21) Appl. No.: 09/883,893

(22) Filed: Jun. 18, 2001

(65) Prior Publication Data

US 2002/0190073 A1 Dec. 19, 2002

(51) Int. Cl.
*G07F 11/00* (2006.01)
*B65H 1/00* (2006.01)

(52) U.S. Cl. ..... 221/35; 221/97; 221/34; 221/45; 221/63

(58) Field of Classification Search ..... 221/34, 221/63, 102, 45, 97; 206/233, 164, 165, 206/494, 812; 220/283, 248, 266, 529, 534, 220/476, 480, 481, 482, 285, 246
See application file for complete search history.

(56) References Cited

U.S. PATENT DOCUMENTS 1,526,149 A 2/1925 Jackson
1,988,939 A 1/1935 Craig
2,055,629 A 9/1936 Marvin
2,915,218 A 12/1959 Rosenman et al.
3,089,586 A * 5/1963 Cole ..... 206/57
3,095,087 A * 6/1963 Yates ..... 206/57
3,141,569 A 7/1964 Hanson
3,221,928 A * 12/1965 Horn ..... 221/34
3,235,196 A 2/1966 Platt
3,843,034 A 10/1974 Lewandowsky
3,845,858 A * 11/1974 Jenkins ..... 206/233
4,151,910 A 5/1979 Yasur
4,553,275 A 11/1985 Goldstein
4,790,436 A 12/1988 Nakamura
4,879,442 A * 11/1989 Giovone ..... 206/233
4,915,257 A 4/1990 Bailey
4,919,302 A * 4/1990 McPherson ..... 221/34
4,955,505 A 9/1990 Battaglia
D312,934 S * 12/1990 Shapland et al. ..... D6/519
5,007,531 A * 4/1991 Lighten ..... 206/77.1
5,013,099 A * 5/1991 Styles et al. ..... 312/37
5,048,582 A 9/1991 Whitfield
5,054,612 A * 10/1991 Meyer, Jr. ..... 206/233
5,076,465 A 12/1991 Lawson
5,111,626 A * 5/1992 Fortune ..... 52/79.1
5,127,545 A 7/1992 French
5,129,545 A 7/1992 Parks
5,669,085 A * 9/1997 Wilson ..... 4/605
5,765,717 A 6/1998 Gottselig (Continued)

FOREIGN PATENT DOCUMENTS

DE 4234787 A1 * 4/1994

(Continued)

*Primary Examiner*—Patrick MacKey
*Assistant Examiner*—Michael Butler
(74) *Attorney, Agent, or Firm*—Buchanan Ingersoll & Rooney PC

(57) ABSTRACT

A bathroom dispenser for dispensing bathing supplies comprising a body having front, back, side and bottom walls defining the dispenser and having at least one dispenser station and at least one disposal station. The dispenser station has a dispensing orifice in one of its walls for dispensing bathing supplies and the disposal station has a receiving orifice in one of its walls for disposing of said bathing supplies.

9 Claims, 4 Drawing Sheets

U.S. PATENT DOCUMENTS 5,803,249 A * 9/1998 Harsani, Jr. et al. ..... 206/233
5,868,227 A 2/1999 Garcia
5,894,612 A 4/1999 Wilson
5,938,094 A 8/1999 Forhan et al.
5,971,142 A 10/1999 Jones
6,073,899 A 6/2000 Omrani
6,129,239 A 10/2000 Fukazawa
6,164,442 A * 12/2000 Stravitz ..... 206/233
6,315,151 B1 11/2001 Hupp et al.
6,371,296 B1 * 4/2002 Rumbough ..... 206/494
6,431,360 B1 * 8/2002 Julius ..... 206/494
6,588,626 B2 * 7/2003 Sauer et al. ..... 221/49
2002/0063136 A1 * 5/2002 Sauer et al. ..... 221/1
2002/0092789 A1 7/2002 Sauer et al.
2002/0121451 A1 * 9/2002 Subramanian et al. ..... 206/494

FOREIGN PATENT DOCUMENTS

GB 2 357 494 6/2001
JP 1-39378 5/1989

* cited by examiner

TISSUE DISPENSER

FIELD OF INVENTION

This invention relates generally to the field of hygienic tissues and paper products for use in a bathroom, and more particularly is a dispenser for use in bathing areas and adjacent areas to provide a supply of tissues to be used by people.

BACKGROUND OF THE INVENTION

In the past, people have typically cleared their nasal passages by using ordinary dry tissues and when such tissues have been used in bathrooms, they have been located in the areas that generally remain dry. Use of these tissues in the dry areas of the bathroom does not result in the most effective cleansing of the nasal passages, because the mucus contained in the nasal passages is not as loose and easy to expel in the dry areas of the bathroom as it is in the areas that are moister and wetter, such as a shower, bathtub, sauna or steam room.

A number of different types of tissues and tissue dispensing devices have been devised and implemented in the past. Traditional dry tissues have taken on a number of embodiments and features, but are basically tissue paper. Wet or "heavy duty" tissues typically consist of tissue paper bonded together with a water-dispersible reinforcing layer, such as a layer laced with a thin film of polyvinyl alcohol and polyvinyl acetate and/or a thermosetting polymer. These tissues typically are designed to be pliable enough for flushing in a toilet, strong enough to be used in moist hygienic applications and biodegradable.

A number of devices have been designed for dispensing tissues. One such device is designed to dispense a roll of moistened towelettes each of which is separable at a perforation, such as that described by Gottselig in U.S. Pat. No. 5,765,717. Another common device uses a cutting mechanism to clamp and sever elements from a tissue web, such as that described by Lewandowsky and Walker in U.S. Pat. No. 3,843,034. Another dispensing device provides a lockable container from which paper towels and tissues may be dispensed via a frontal orifice, such as that described by Bailey in U.S. Pat. No. 4,915,257. A dispensing device for use in the shower is described by Goldstein in U.S. Pat. No. 4,553,275 for use in dispensing soap-impregnated washcloths.

As mentioned, tissue and tissue dispensing technologies are fairly well developed; however, existing technologies do not maximize the effective use of such technologies. Further, existing dispensers do not provide for easily accessible and convenient disposal mechanisms. As a result, significant improvement can still be made in the area of tissue dispensing and tissue waste handling.

It is the primary object of the present invention to enable people to utilize tissues in wet and moist areas of the bathroom in which nasal passages are more easily cleaned of mucus, other bodily fluids and secretions, and other bodily substances such as makeup. Another object of the invention is to permit people, especially those with allergies, to take advantage of the moist environments of the bathroom to permit clearing of their nasal passages when they are more susceptible to such clearings. Another object of the invention is to make the disposal of used tissue easier by including a disposal device which permits easy and convenient disposal of used tissues by the person.

SUMMARY OF THE INVENTION

The present invention utilizes a heavy-duty tissue, either wet or dry, dispensed from a tissue dispensing device located in the moist areas of the bathroom, such as the shower, bathtub, sauna or steam room. To further increase the utility of the location of the dispenser, the invention also includes a disposal device along with the dispenser to permit convenient disposal of the waste tissue. As a result of the device, people may clean their nasal passages in these beneficial, moist environments.

The size and shape specifications of the tissues and dispenser can be varied and they can be positioned in a variety of arrangements. In the preferred embodiment, the tissues are heavy-duty tissues dispensed from a cartridge out of the bottom of the dispenser portion of the invention and a disposal device is an integral part of the invention.

In another embodiment, the invention has dispenser and disposal portions not separated by any internal walls; instead, a single cartridge contains tissues for dispensing on one side and contains an initially empty disposal station on the other side into which the used tissues are placed. After consumption of all of the tissues in the cartridge, the entire used cartridge is replaced with a new cartridge.

DETAILED DESCRIPTION

Figure 1:
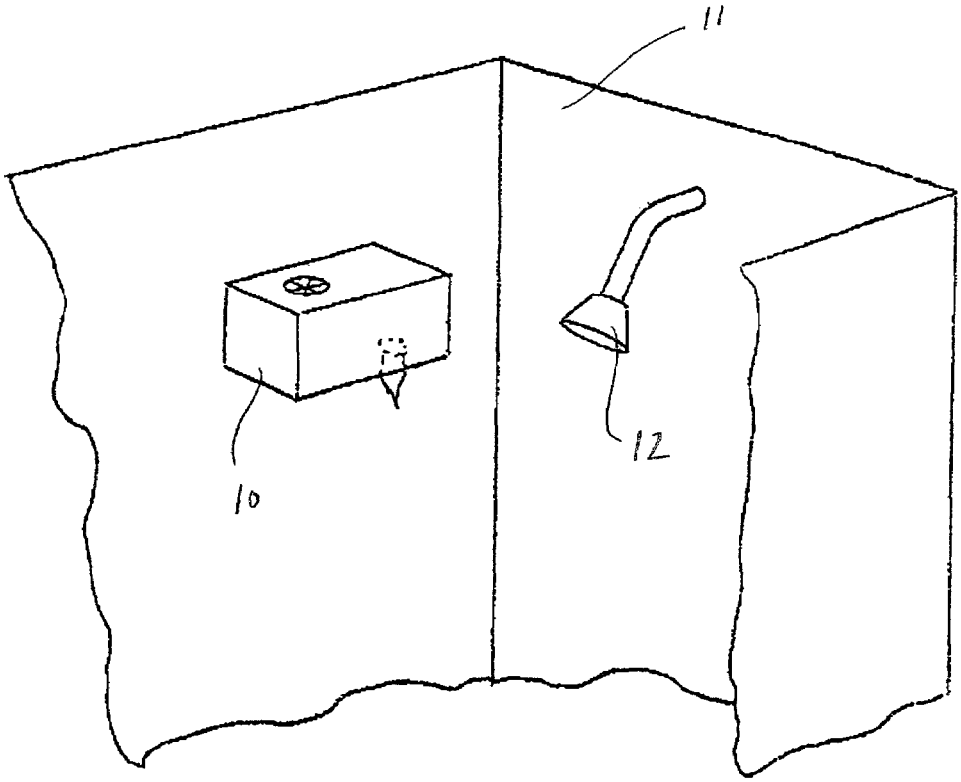
FIG. 1 is a fragmentary perspective view of a showerbath room or stall equipped with the present invention.

As illustrated in FIG. 1, a dispenser indicated generally by the character numeral 10 is shown in a showerbath room/stall 11 in which the person may easily reach the dispenser 10 from underneath a typical shower spray head 12.

Figure 2:
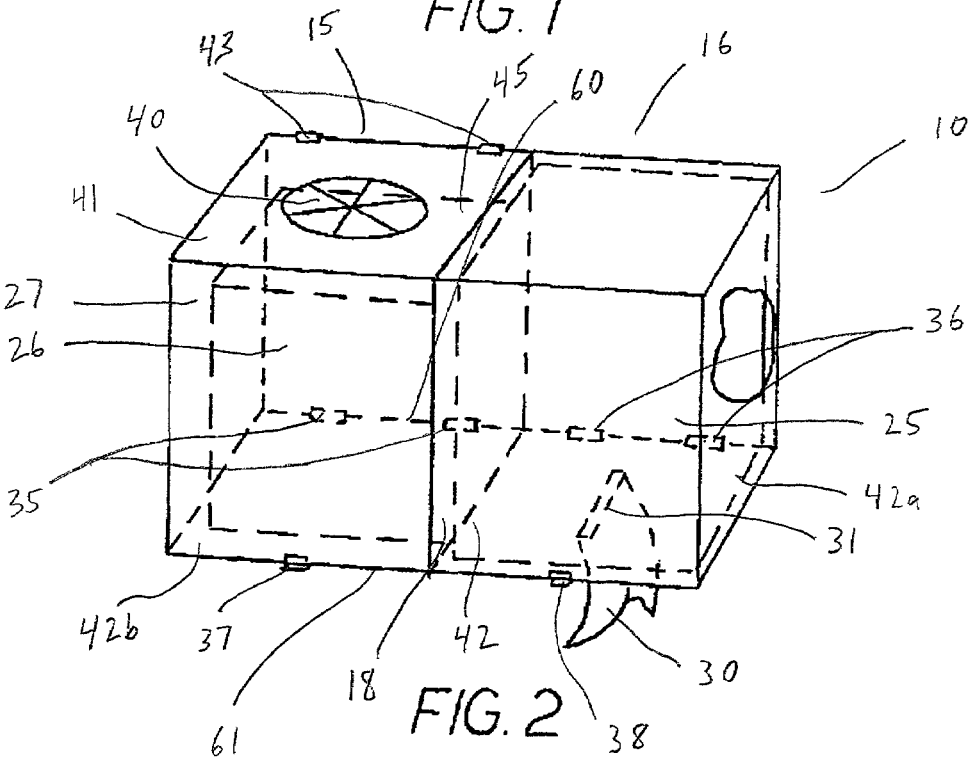
FIG. 2 is a perspective view of an embodiment of the present invention, parts being broken away for clarity.

As illustrated in the perspective of FIG. 2, a dispenser 10 is shown having a horizontal configuration although other and different exterior configurations may be used as desired. Dispenser 10 is comprised of two major sections, a dispenser station 16 separated from a repository or disposal station 15 by an internal wall 18 essentially spanning the width and depth of the dispenser 10. Dispenser station 16 defines a volume adapted to removably house and secure a tissue cartridge 25. Cartridge 25 is secured by fitting snugly into the volume or alternatively by using clips or other restraining devices. Cartridge 25 contains a multiplicity of tissues 30 that can be pulled through a dispensing orifice 31 defined in the bottom wall 42 of dispenser 10 in a "pop out" manner well known in the prior art. Access to the interior of the dispensing station 16 is provided by pivotable door 42*a* forming a portion of the bottom wall 42 of the dispenser 10. Door 42*a* is mounted to the dispenser 10 by hinges 36 located along the back edge 60 thereof and is secured in a closed position by a latch mechanism 38 positioned along the opposite front edge 61. Thus, when the tissues 30 in a cartridge 25 are exhausted, it may easily be replaced with a new cartridge.

The disposal station 15 defines a disposal volume 27 for accommodating a removable receptacle 26 for receiving used tissues or alternatively for directly receiving used tissues. In a manner similar to the dispensing station 16, disposal station 15 is provided with a door 42*b* pivotally attached to the dispenser 10 by hinges 35 and latched in the closed position by a latch mechanism 37. Disposal station 15 also has a second pivotable door 41 mounted to the dispenser 10 by hinges 43 located along the back top edge of the dispenser. Used tissues are inserted into station 15, disposal volume 27 and receptacle 26 through an array of flexible fingers forming a grommet like member defining an opening 40 located on the top wall 45 of the disposal station 15. The refuse receptacle 26 within disposal volume 27 can receive the tissues and be removed and discarded or cleaned and returned to the disposal volume 27. In this manner, the user does not physically touch the used tissues when removing them. Alternatively, as mentioned above, if used tissue are placed directly into the disposal volume 27, as the disposal volume 27 becomes filled, the user can remove the used tissues and clean the interior via opening door 42*b*.

The dispenser 10 preferably is provided with a pressure sensitive, water resistant adhesive or tape to enable the dispenser 10 to be secured to a wall or like. However, it should be understood that other fastening techniques may be employed as well such as, for example, a sliding eyelet and bolt fastening apparatus allowing the dispensers to be removably secured to a supporting wall or structure or suspending the dispenser 10 over a shower spray head using a cord or rope.

Figure 2A:
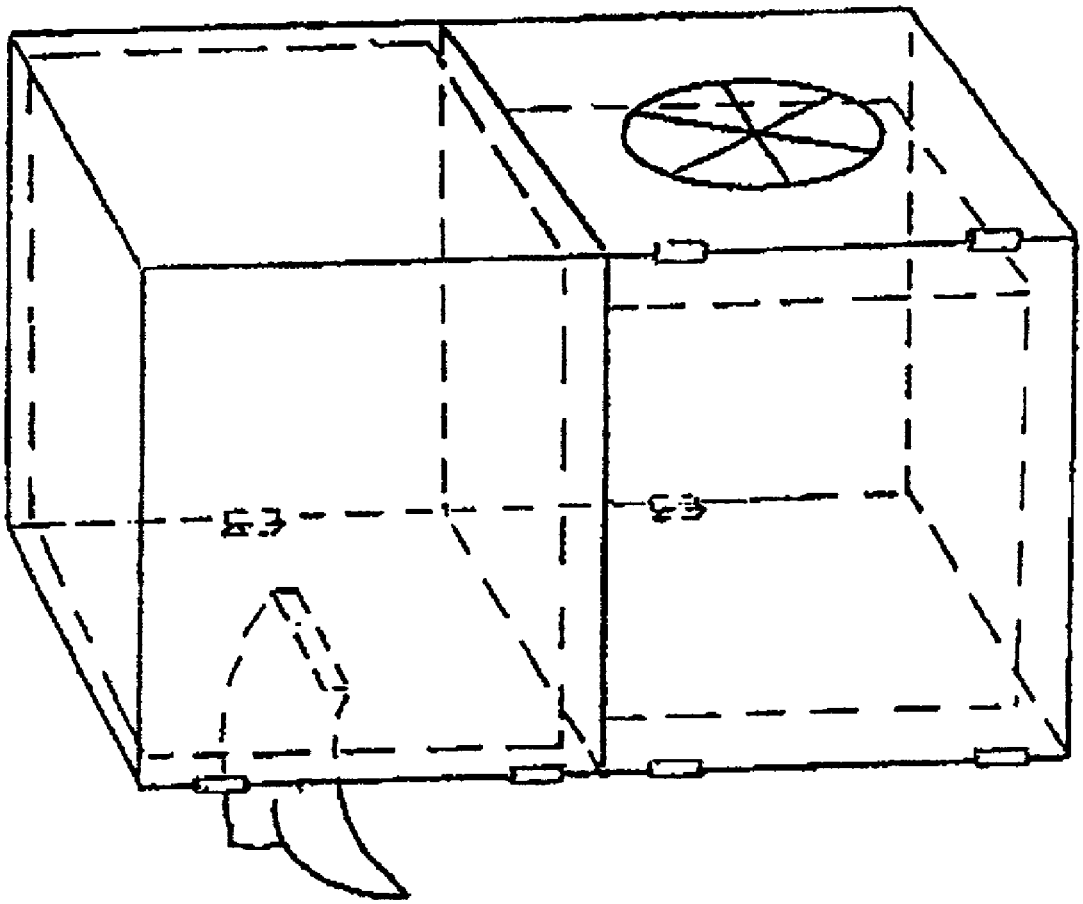
FIG. 2A is a rear perspective view of FIG. 2, parts being broken away for clarity.

FIG. 2A illustrates a rear perspective of the dispenser 10 described in FIG. 2.

Figure 3:
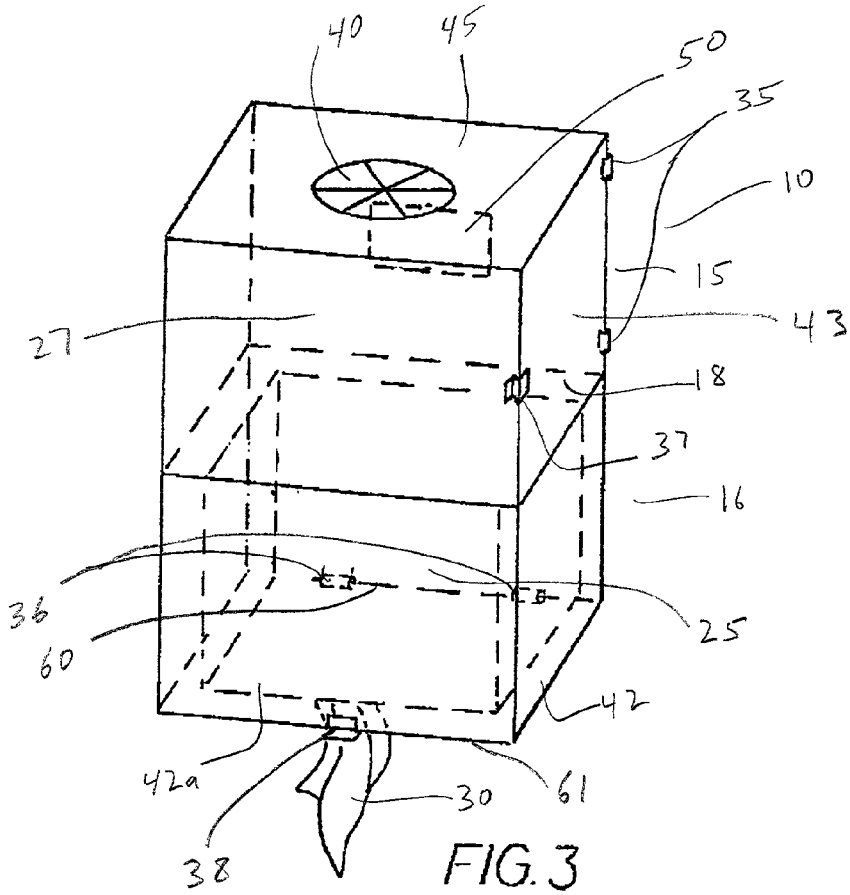
FIG. 3 is a perspective view of an embodiment of the present invention, parts being broken away for clarity.

As illustrated in the perspective of FIG. 3, a dispenser 10 is shown having a vertical configuration although other and different exterior configurations may used as desired. Dispenser 10 is comprised of two major sections, a dispenser station 16 separated from a repository or disposal station 15 by an internal wall 18 essentially spanning the length and width of the dispenser 10. Dispenser station 16 defines a volume adapted to removably house and secure a tissue cartridge 25. Cartridge 25 is secured by fitting snugly into the volume or alternatively by using clips or other restraining devices. Cartridge 25 contains a multiplicity of tissues 30 that can be pulled through a dispensing orifice defined in the bottom wall 42 of dispenser 10 in a "pop out" manner well known in the prior art. Access to the interior of the dispensing station 16 is provided by pivotable door 42*a* forming all or a portion of the bottom wall 42 of the dispenser 10. Door 42*a* is mounted to the dispenser 10 by hinges 36 located along the back edge 60 thereof and is secured in a closed position by a latch mechanism 38 positioned along the opposite front edge 61. Thus, when the tissues 30 in a cartridge 25 are exhausted, it may easily be replaced with a new cartridge.

The disposal station 15 defines a disposal volume 27 for directly receiving used tissues or alternatively for accommodating a removable receptacle for receiving the used tissues. In a manner similar to the dispensing station 16, disposal station 15 is provided with a door 43 pivotally attached to the dispenser 10 by hinges 35 and latched in the closed position by a latch mechanism 37. Used tissues are inserted into station 15 and disposal volume 27 through an array of flexible fingers forming a grommet like member defining an opening 40 located on the top wall 45 of the disposal station 15. The used tissues are placed directly into the disposal volume 27 and as the disposal volume 27 becomes filled, the user can remove the used tissues and clean the interior via the door 43. Alternatively, as mentioned above, a refuse receptacle used within disposal volume 27 can receive the tissues and be removed and discarded or cleaned and returned to the disposal volume 27. In this manner, the user does not physically touch the used tissues when removing them.

The dispenser 10 preferably is provided with a pressure sensitive, water resistant adhesive or tape 50 to enable the dispenser 10 to be secured to a wall or like. However, it should be understood that other fastening techniques may be employed as well such as, for example, a sliding eyelet and bolt fastening apparatus allowing the dispensers to be removably secured to a supporting wall or structure or suspending the dispenser 10 over a shower spray head using an elongated element such as a cord or rope.

Figure 4:
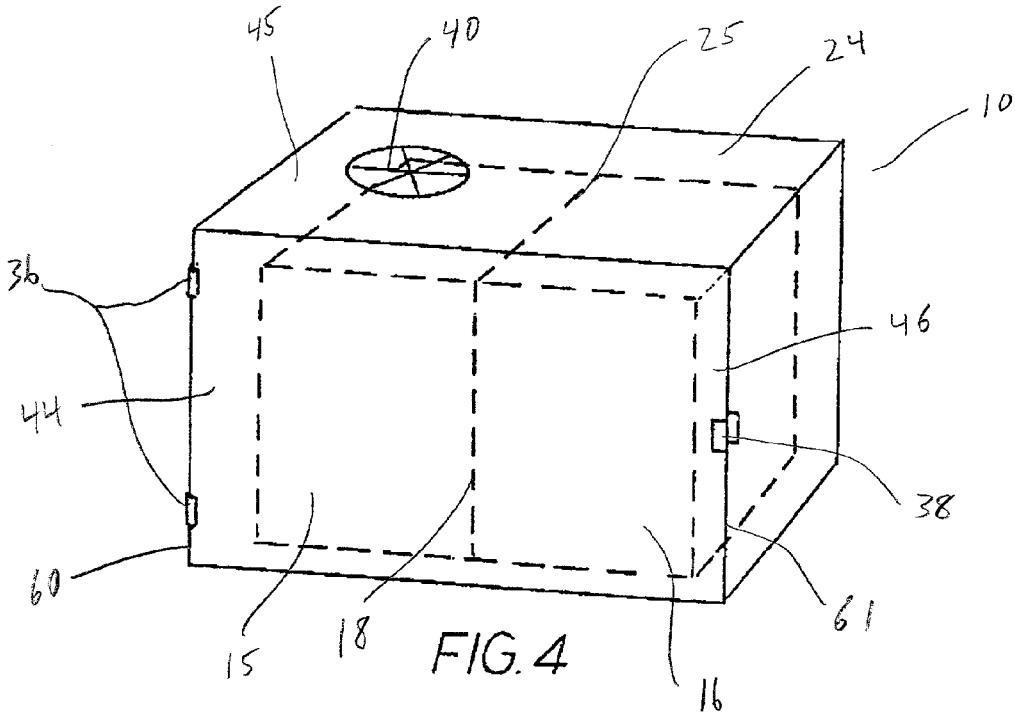
FIG. 4 is a perspective view of another embodiment of the present invention, parts being broken away for clarity.

As illustrated in the perspective of FIG. 4, another embodiment of the dispenser 10 is shown having a horizontal configuration although other and different exterior configurations may used as desired. The dispenser 10 defines a station 24 adapted to removably house and secure a tissue and refuse cartridge 25. The cartridge 25 is secured by fitting snugly into the station 24 or alternatively by using clips or other restraining devices. The cartridge 25 is comprised of two major sections, a dispenser section 16 separated from a repository or disposal section 15 by an internal wall 18 essentially spanning the width and depth of the cartridge 25. The dispenser section 16 contains a multiplicity of tissues that can be pulled through a dispensing orifice defined in the bottom wall of dispenser 10 in a "pop out" manner well known in the prior art. Used tissues are inserted into the disposal section 15 through an array of flexible fingers forming a grommet like member defining an opening 40 located on the top wall 45 of the dispenser 10. Access to the station 24 is provided by pivotable door 44 forming all of or a portion of the front wall 46 of the dispenser 10. Door 44 is mounted to the dispenser 10 by hinges 36 located along the left front edge 60 thereof and is secured in a closed position by a latch mechanism 38 positioned along the opposite front edge 61. Thus, when the tissues in a cartridge 25 are exhausted, it may easily be replaced with a new cartridge.

The dispenser 10 preferably is provided with a pressure sensitive, water resistant adhesive or tape to enable the dispenser 10 to be secured to a wall or like. However, it should be understood that other fastening techniques may be employed as well such as, for example, a sliding eyelet and bolt fastening apparatus allowing the dispensers to be removably secured to a supporting wall or structure or suspending the dispenser 10 over a shower spray head using a cord or rope.

Figure 5:
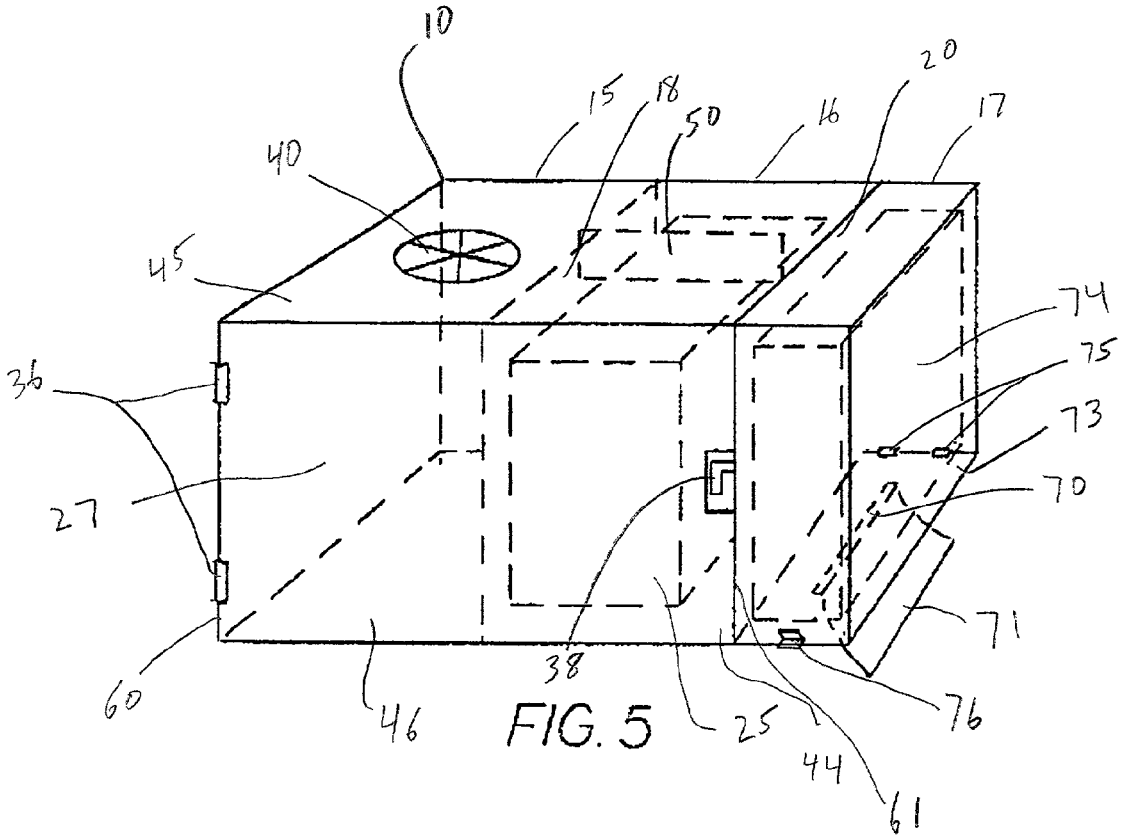
FIG. 5 is a perspective view of another embodiment of the present invention, parts being broken away for clarity.

As illustrated in the perspective of FIG. 5, a dispenser 10 is shown having a horizontal configuration although other and different exterior configurations may used as desired. Dispenser 10 is comprised of three major sections, a first dispenser station 16 separated from a repository or disposal station 15 by a first internal wall 18 essentially spanning the width and depth of the dispenser 10 and a second dispenser station 17 separated from the first dispenser station 16 by a second internal wall 20 essentially spanning the width and depth of the dispenser 10. Dispenser station 16 defines a volume adapted to removably house and secure a tissue cartridge 25. Cartridge 25 is secured by fitting snugly into the volume or alternatively by using clips or other restraining devices. Cartridge 25 contains a multiplicity of tissues that can be pulled through a dispensing orifice defined in the bottom wall of dispenser 10 in a "pop out" manner well known in the prior art. The disposal station 15 defines a disposal volume 27 for directly receiving used tissues or alternatively for accommodating a removable receptacle for receiving the used tissues. Used tissues are inserted into station 15 and disposal volume 27 through an array of flexible fingers forming a grommet like member defining an opening 40 located on the top wall 45 of the disposal station 15. Access to the disposal volume 27 and cartridge 25 is provided by pivotable door 44 forming a portion of the front wall 46 of the dispenser 10. Door 44 is mounted to the dispenser 10 by hinges 36 located along the left front edge 60 thereof and is secured in a closed position by a latch mechanism 38 positioned along the opposite door edge 61. Thus, when the tissues in a cartridge 25 are exhausted and/or the disposal volume 27 becomes filled, the user it may easily replace the cartridge 25 with a new cartridge and/or remove the used tissues and clean the interior by opening door 44.

The second dispenser station 17 also defines a volume adapted to removably house and secure a tissue cartridge 74. Cartridge 74 is secured by fitting snugly into the volume or alternatively by using clips or other restraining devices. Cartridge 74 contains a multiplicity of towelettes 71 that can be pulled through a dispensing orifice 70 defined in the bottom wall of dispenser 10 in a "pop out" manner well known in the prior art. The towelettes 71 can be impregnated with fragrances or medicinal products. Access to the second dispenser station volume and cartridge 74 is provided by pivotable door 73 forming a portion of the bottom wall of the dispenser 10. Door 73 is mounted to the dispenser 10 by hinges 75 located along the lower back edge thereof and is secured in a closed position by a latch mechanism 76 positioned along the opposite front edge. Thus, when the tissues in a cartridge 74 are exhausted, the user it may easily replace the cartridge 74 with a new cartridge simply by opening door 73.

The dispenser 10 preferably is provided with a pressure sensitive, water resistant adhesive or tape 50 to enable the dispenser 10 to be secured to a wall or like. However, it should be understood that other fastening techniques may be employed as well such as, for example, a sliding eyelet and bolt fastening apparatus allowing the dispensers to be removably secured to a supporting wall or structure or suspending the dispenser 10 over a shower spray head using a cord or rope.

Figure 6:
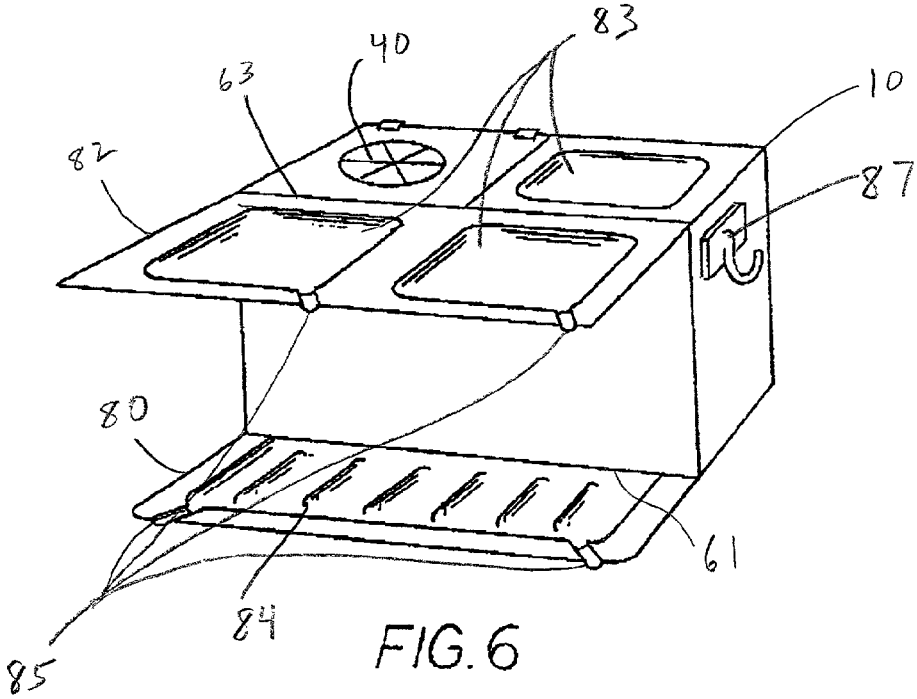
FIG. 6 is a perspective view like that of FIG. 2 depicting another embodiment of the present invention.

As illustrated in the perspective of FIG. 6, another embodiment of the dispenser 10 is shown having a horizontal configuration although other and different exterior configurations may used as desired. Dispenser 10 includes an upper shelf 82 that extends the top surface of the dispenser 10 from the upper front edge 63 and a lower shelf 82 that extends from the lower front edge 61. The lower shelf 80 contains a ridged surface 84, as is commonly found in many soap trays, to permit slip-free, relatively dry storage of soap and other toiletries. The upper shelf 82 contains partitions 83 located around the array of flexible fingers forming a grommet like member defining an opening 40 for secure storage of a variety of bathing supplies, such as soap, shampoo, conditioner, washcloths, etc. The upper shelf 82 and lower shelf 80 also contain drains 85 consisting of holes ot tunnels in the partitions 83 and ridged surface 84 to remove the water from such surfaces. The dispenser also has a hook 87 for holding hand towels and/or washcloths. Thupper shelf 82 and lower shelf 80 also act to deflect some of the water from a shower head away from the tissues dispensed by the dispenser 10.

The preceding description of the uinvention has shown and described certain embodiments thereof; however, it is intended by way of illustration and example only and not by way of limitation. Those skilled in the art should understand that various changes, omissions and additions may be made to the invention without departing from the spirit and scope of the invention.

I claim:

1. A method of providing tissues in a shower stall comprising the steps of:

A) providing a tissue dispenser having a tissue dispenser station containing tissues to be dispensed, and a tissue disposal station for receiving used tissues, the tissue dispenser station separated from the tissue disposal station by a wall and having a tissue dispensing orifice, the tissue disposal station having a tissue disposing orifice; and B) mounting the tissue dispenser at the shower stall above floor level.

2. The method according to claim 1 wherein step B comprises mounting the dispenser with the tissue dispensing orifice facing downwardly.

3. The method according to claim 2 wherein step B comprises mounting the dispenser with the tissue disposing orifice facing upwardly.

4. The method according to claim 1 wherein step B comprises mounting the dispenser with the tissue dispensing orifice and the tissue disposing orifice facing in mutually opposite directions.

5. The method according to claim 1 wherein step B comprises mounting the dispenser with the tissue disposal station and the tissue dispenser station disposed one above the other.

6. The method according to claim 5 wherein the tissue disposal station overlies the tissue dispensing station.

7. The method according to claim 1 wherein step B comprises adhering the dispenser to a vertical wall by a fastener disposed on a rear portion of the dispenser.

8. The method according to claim 1 wherein step B comprises suspending the dispenser from a support by an elongated element.

9. The method according to claim 1 wherein step B comprises mounting the dispenser with the tissue disposal station overlying the tissue dispenser station, and with the tissue dispensing orifice facing downwardly and the tissue disposing orifice facing upwardly; step B also comprising adhering the dispenser to a vertical wall by a fastener disposed on a rear portion of the dispenser.

* * * * *